US009297575B1

(12) United States Patent
Gardner

(10) Patent No.: US 9,297,575 B1
(45) Date of Patent: Mar. 29, 2016

(54) RESERVOIR AND METHOD OF MAKING

(71) Applicant: Mercury Plastics, Inc., Middlefield, OH (US)

(72) Inventor: Scott R. Gardner, Middlefield, OH (US)

(73) Assignee: Mercury Plastics, Inc., Middlefield, OH (US)

( * ) Notice: Subject to any disclaimer, the term of this patent is extended or adjusted under 35 U.S.C. 154(b) by 196 days.

(21) Appl. No.: 13/944,471

(22) Filed: Jul. 17, 2013

Related U.S. Application Data

(60) Provisional application No. 61/672,753, filed on Jul. 17, 2012.

(51) Int. Cl.
*F25D 23/12* (2006.01)
*F25D 31/00* (2006.01)

(52) U.S. Cl.
CPC ..... *F25D 23/126* (2013.01); *F25D 31/002* (2013.01); *F25D 31/006* (2013.01); *F25D 2323/122* (2013.01); *F25D 2331/806* (2013.01);
(Continued)

(58) Field of Classification Search
CPC ..... F25D 2331/806; F25D 2331/811; F25D 23/126; F25D 31/006; F25D 31/002; F25D 2323/122; Y10T 137/86364; Y10T 37/86332; Y10T 37/86348; Y10T 37/8634
USPC ..... 137/588, 590, 591; 285/124.4, 124.3, 285/124.2, 124.1; 62/389; 222/478, 479, 222/481, 481.5, 482, 484; 141/25, 285, 141/290, 309
See application file for complete search history.

(56) References Cited

U.S. PATENT DOCUMENTS 3,722,538 A * 3/1973 Gezari ..... 137/588
4,204,613 A * 5/1980 Terzian et al. ..... 222/146.6
(Continued)

FOREIGN PATENT DOCUMENTS

CA 2269687 C 4/2005
DE 2341728 A1 * 2/1974
(Continued)

OTHER PUBLICATIONS

DE 2341728 English translation of abstract/title supplied by Derwent.*
(Continued)

*Primary Examiner* — Craig Schneider
*Assistant Examiner* — Josephine Trinidad-Borges
(74) *Attorney, Agent, or Firm* — Hahn Loeser & Parks, LLP

(57) ABSTRACT

A reservoir for use in a water distribution system within a refrigeration device includes a container having a vessel portion terminating in a neck having an opening, and a cap sealingly engaging the neck. The cap has an internal surface in communication with an interior of the vessel portion, an external surface opposite the internal surface, an inlet aperture and an outlet aperture through the cap in fluid communication with the container opening, and an inlet tube in fluid communication with the inlet aperture extending from the external surface. The cap may sealingly engage the neck by only one seal. The cap may further include an outlet tube in fluid communication with the outlet aperture extending from the external surface. In certain embodiments, a dip tube may be provided in fluid communication with the outlet aperture extending from the internal surface into the vessel portion.

23 Claims, 9 Drawing Sheets

(52) U.S. Cl.
CPC ..... *F25D 2331/811* (2013.01); *Y10T 137/8634* (2015.04); *Y10T 137/86332* (2015.04); *Y10T 137/86348* (2015.04); *Y10T 137/86364* (2015.04)

(56) References Cited

U.S. PATENT DOCUMENTS

| | | | | |
|---|---|---|---|---|
| 5,769,138 | A * | 6/1998 | Sadowski et al. | 141/329 |
| 5,861,200 | A | 1/1999 | Rowley et al. | |
| 5,895,695 | A | 4/1999 | Rowley et al. | |
| 5,965,077 | A | 10/1999 | Rowley et al. | |
| 6,070,916 | A | 6/2000 | Rowley et al. | |
| 6,082,780 | A | 7/2000 | Rowley et al. | |
| 6,116,884 | A | 9/2000 | Rowley et al. | |
| 6,270,125 | B1 | 8/2001 | Rowley et al. | |
| 6,287,501 | B1 | 9/2001 | Rowley | |
| 6,485,666 | B1 | 11/2002 | Rowley | |
| 6,732,543 | B2 | 5/2004 | Jenkins, Jr. et al. | |
| 6,783,160 | B2 | 8/2004 | Rowley | |
| 6,838,041 | B2 | 1/2005 | Rowley | |
| 6,848,719 | B2 | 2/2005 | Rowley | |
| 6,902,210 | B1 | 6/2005 | Rowley | |
| 7,118,138 | B1 | 10/2006 | Rowley et al. | |
| 7,234,317 | B2 | 6/2007 | Jenkins, Jr. et al. | |
| 7,766,043 | B2 | 8/2010 | Thomas et al. | |
| 7,819,137 | B2 | 10/2010 | Nelson et al. | |
| 7,850,898 | B1 | 12/2010 | Rowley et al. | |
| 7,891,382 | B2 | 2/2011 | Rushlander et al. | |
| 7,927,534 | B1 | 4/2011 | Seman, Sr. et al. | |
| 2006/0264044 | A1 * | 11/2006 | Kobayashi et al. | 438/680 |
| 2007/0039918 | A1 * | 2/2007 | Lane et al. | 215/381 |
| 2009/0071981 | A1 * | 3/2009 | Scardino | 222/146.6 |
| 2010/0163479 | A1 * | 7/2010 | Kim | E03B 11/06 210/348 |
| 2010/0229592 | A1 * | 9/2010 | Lim et al. | 62/389 |
| 2012/0068386 | A1 * | 3/2012 | Rushlander et al. | 264/541 |

FOREIGN PATENT DOCUMENTS

| | | | |
|---|---|---|---|
| DE | 2421359 | A1 * | 11/1975 |
| EP | 1581378 | B1 | 1/2010 |

OTHER PUBLICATIONS

DE2421359—English translation of the description supplied by the European Patent Office.*

Whirlpool 4396841 PUR Push Button Side-by-Side Refrigerator Water Filter, http://www.amazon.com/Whirlpool-4396841-Button-Refrigerator-Filter/dp/B000UW2DTE, Oct. 15, 2013.

In the Grille Fast-Fill Push Button (2Pack) Other, http://m.whirlpool.com/Home/ProductDetail/4396841P, Oct. 15, 2013.

* cited by examiner

RESERVOIR AND METHOD OF MAKING

CROSS-REFERENCE TO RELATED APPLICATION

This application claims priority from U.S. Provisional Patent Application Ser. No. 61/672,753 filed Jul. 17, 2012.

BACKGROUND AND SUMMARY

It is known to provide dispenser units in the front doors of refrigerators in order to enhance the accessibility to ice and/or water. Typically, such a dispenser unit will be formed in the freezer door of a side-by-side style refrigerator or in the fresh food or freezer door of a top mount style refrigerator. In either case, a water line will be connected to the refrigerator in order to supply the needed water for the operation of the dispenser. For use in dispensing the water, it is common to provide a water tank within the fresh food compartment to act as a reservoir such that a certain quantity of the water can be chilled prior to being dispensed.

Certain dispenser equipped refrigerators available on the market today incorporate blow molded water tanks which are positioned in the fresh food compartments of the refrigerator. More specifically, such a water tank is typically positioned in the back of the fresh food compartment, for example, behind a crisper bin or a meat keeper pan so as to be subjected to the cooling air circulating within the compartment. Since the tank is typically not an aesthetically appealing feature of the refrigerator, it is generally hidden from view by a sight enhancing cover.

For certain other dispenser equipped refrigerators, the reservoir may be molded, for example, by a process disclosed in U.S. Pat. No. 7,850,898, in which a heated extrudate is positioned in a mold followed by insertion of previously extruded profiles that are inserted into the beginning and end apertures of the main extrudate body. The mold is closed and pressure applied through the inserted profiles to expand the main extrudate body to fill the mold cavity. forming an essentially leak-proof seal between the extrudate body and the inserted profiles.

What is disclosed herein is a reservoir useful in a refrigerator water dispensing system comprising one or more of the features hereinafter fully described and particularly pointed out in the claims. The following description and the annexed drawings set forth in detail certain illustrative embodiments of the invention, being indicative of but a few of the various ways in which the principles of the invention may be employed.

DETAILED DESCRIPTION OF THE PREFERRED EMBODIMENTS

Figure 1:
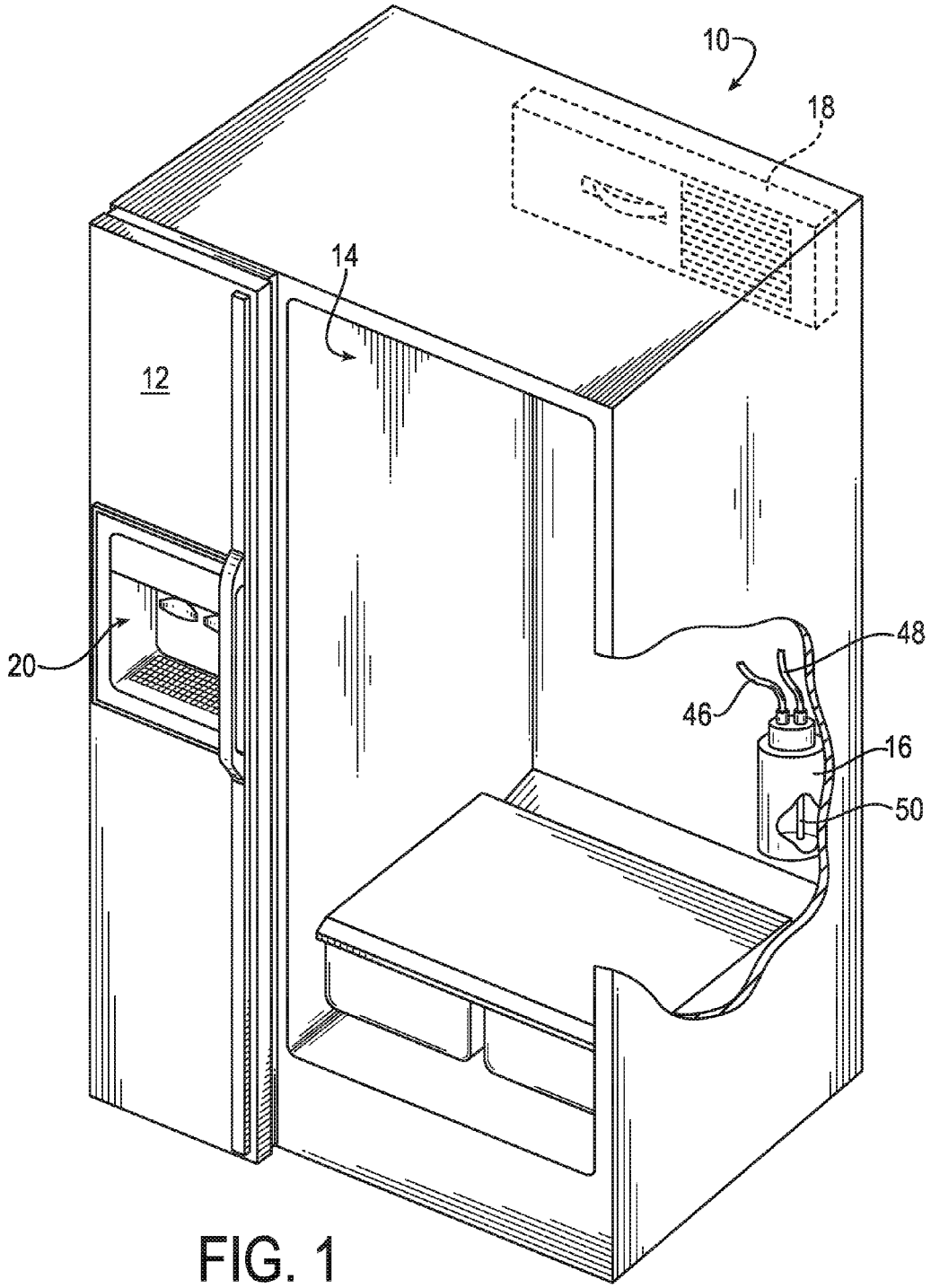
FIG. 1 is a partial perspective view of a refrigerator showing a diagrammatical cutaway view of a reservoir of the present disclosure.

Referring now to FIG. 1, a refrigerator 10 of the side-by-side type wherein there is a freezer compartment on the left hand side closed by a freezer door 12 and a fresh food compartment 14, shown in FIG. 1 with the fresh food access door and shelves removed. Various internal refrigerator components have been omitted in order to see a diagrammatical representation of a water storage reservoir 16. A cold air control assembly 18 and a refrigeration system (not shown) regulates the temperature of the freezer compartment and the fresh food compartment to keep the refrigerator at a desired temperature.

The household refrigerator shown in FIG. 1 is of a side-by-side type and has in the outside of the freezer door 12 a dispensing compartment 20 wherein a user may obtain, for example, ice cubes and/or cold water depending upon the selection by pressing one or the other of the actuators. Not shown is a length of tube connecting the water storage reservoir 16 to the dispensing compartment 20 for dispensing water or a length of tube connecting the water storage reservoir 16 to a valve connected to a source of water, such as a household water supply.

Figure 2:
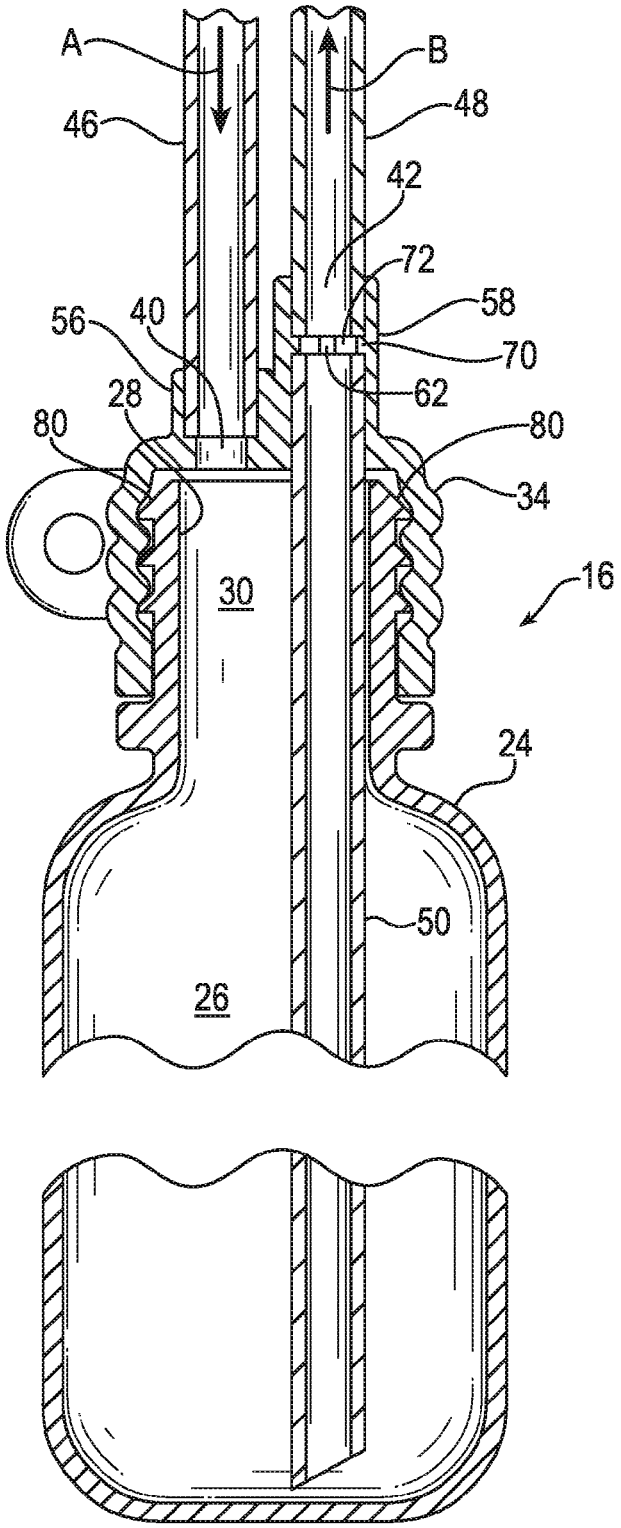
FIG. 2 is a partial cross-sectional view of the reservoir shown in FIG. 1.
Figure 3:
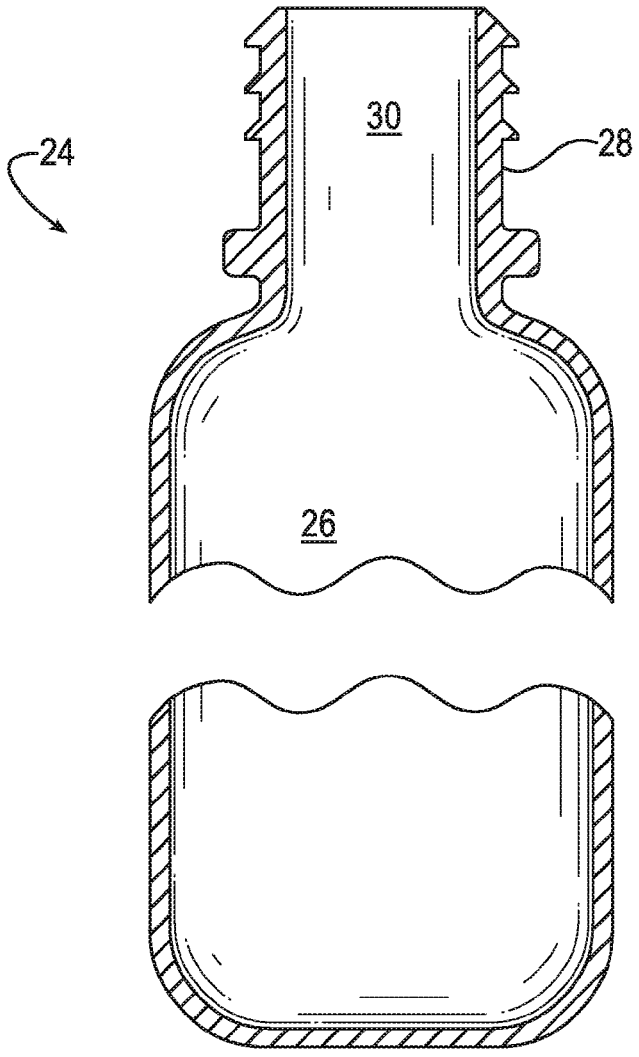
FIG. 3 is a partial cross-sectional view of a container for the reservoir of FIG. 2.

With reference to FIGS. 1 through 4, the water storage reservoir 16 has an inlet shown as "A" in FIG. 2, and an outlet "B." The reservoir 16 includes a container 24 having a vessel portion 26 terminating at a neck 28 around an opening 30, and a cap 34 sealingly engaging the neck 28. The cap 34 has an internal surface 36 in communication with an interior of the vessel portion 26, and an external surface 38 opposite the internal surface 36. The cap 34 also includes an inlet aperture 40 and an outlet aperture 42 through the cap 34 in fluid communication with the container opening 30. The cap 34 further includes an inlet tube 46 in fluid communication with the inlet aperture 40 extending from the external surface 38 away from the reservoir. The cap 34 may further include an outlet tube 48 in fluid communication with the outlet aperture 42 extending from the external surface 38. The inlet tube 46 and the outlet tube 48, or portions of the inlet tube 46 and the outlet tube 48, may be flexible or comprise flexible tubing. In certain embodiments, such as shown in FIGS. 1 and 2, a dip tube 50 may be provided in fluid communication with the outlet aperture 42 extending from the internal surface 36 into the vessel portion 26.

For certain applications, at least a portion of the inlet tube 46 may be integrally formed with the cap 34. For example, the inlet tube 46 may be a barb fitting formed with the cap for attachment of a connecting tube. Alternatively, the inlet tube may be a tube fitting or connection integral to the cap, a molded tubular portion, or an attached length of tube. Similarly, in various alternatives, at least a portion of the outlet tube 48 may be integrally formed with the cap 34. For example, the outlet tube 48 may be a barb fitting formed with the cap for attachment of a connecting tube. Alternatively, the outlet tube may be a tube fitting or connection integral to the cap, a molded tubular portion, or an attached length of tube, as desired.

Figure 4:
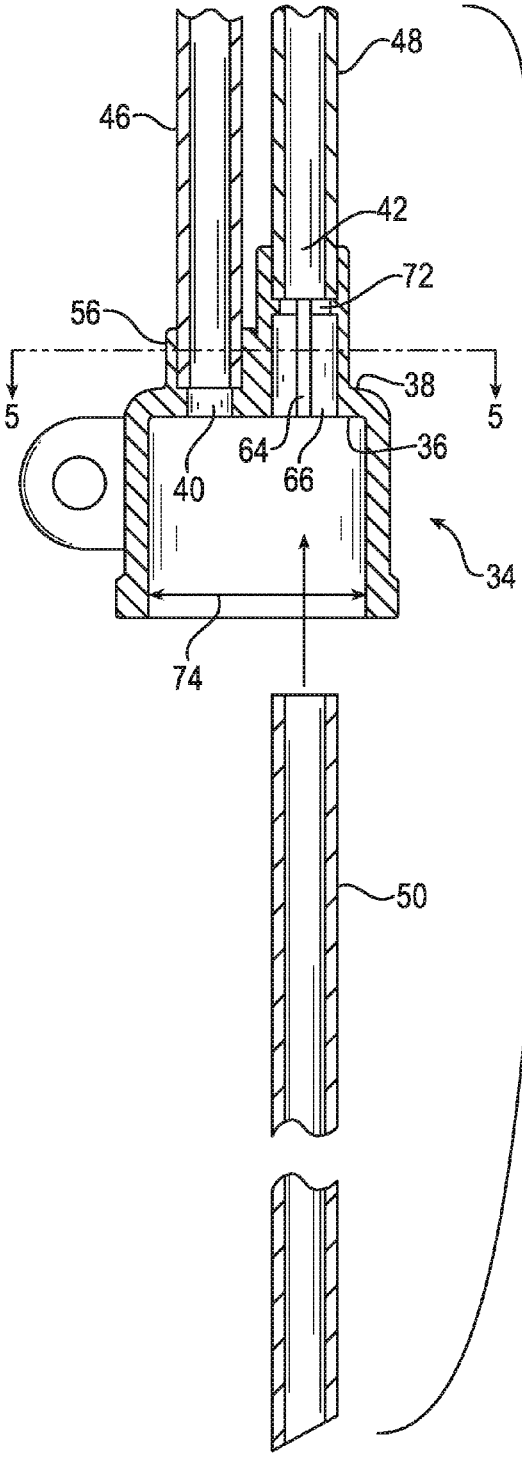
FIG. 4 is a partial cross-sectional view of a cap and dip tube for the reservoir of FIG. 2.

As shown in FIGS. 2 and 4, the cap 34 may include a cylindrical inlet flange 56 sealingly engaging an end of the inlet tube 46 forming the inlet aperture 40 and a cylindrical outlet flange 58 sealingly engaging an end of the outlet tube 48 forming the outlet aperture 42. The cylindrical inlet flange 56 may be integrally formed with the cap 34 about the inlet aperture 40 to engage the inlet tube 46. Similarly, the cylindrical outlet flange 58 may be integrally formed with the cap 34 about the outlet aperture 42 to engage the outlet tube 48. In one alternative, an end of the inlet tube 46 may attach to the cap by frictionally engaging the cylindrical inlet flange 56, and an end of the outlet tube 48 may attach to the cap by frictionally engaging the cylindrical outlet flange 58. In one alternative, the cap may be overmolded around the inlet tube 46 and the outlet tube 48 such that the cylindrical inlet flange 56 is molded around the inlet tube 46 and the cylindrical outlet flange 58 is molded around the outlet tube 48 as further discussed below.

As used in this application, the term "overmold" means the process of injection molding a second polymer over a first polymer, wherein the first and second polymers may or may not be the same. In one embodiment of the invention, the composition of the overmolded polymer of the cap will be such that it will be capable of at least some melt fusion with the composition of the polymeric tube. There are several means by which this may be affected. One of the simplest procedures is to insure that at least a component of the polymeric tube and that of the overmolded polymer is the same. Alternatively, it would be possible to insure that at least a portion of the polymer composition of the polymeric tube and that of the overmolded polymer is sufficiently similar or compatible so as to permit the melt fusion or blending or alloying to occur at least in the interfacial region between the exterior of the polymeric tube and the interior region of the overmolded polymer. Another manner in which to state this would be to indicate that at least a portion of the polymer compositions of the polymeric tube and the overmolded polymer are miscible. However, if the chemical compositions of the polymers are relatively incompatible, then less of a material-to-material bond will be formed by the injection overmolding process.

It is contemplated that any of the various configurations may be applied to attach an inlet tube to the cap, while a different configuration may be applied to attach an outlet tube to the cap. For example, the cap may be overmolded around an outlet tube to affix the outlet tube to the cap, while the molded cap geometry may include an inlet tube as a barbed fitting for subsequent assembly. In another example, the cap may be overmolded around an inlet tube to affix the inlet tube to the cap, while the molded cap geometry may include a cylindrical outlet flange into which an outlet tube is frictionally inserted. Any of the various configurations and attachment techniques described herein may be applied to the inlet and outlet of the cap separately within the scope of the disclosure.

As shown in FIG. 2, the inside of the cylindrical outlet flange 58 and/or the outlet aperture 42 may be sized for insertion and retention of the dip tube 50. The dip tube 50 may be frictionally inserted into the cylindrical outlet flange 58 and/or the outlet aperture 42 from the inside surface 36 of the cap in fluid communication with the outlet tube 48. The cylindrical outlet flange 58 may be operably configured to connect the outlet tube 48 and the dip tube 50, where the outlet tube and the dip tube are positioned within the cylindrical outlet flange 58.

In order to fill the reservoir to a desired level and subsequently dispense water, the reservoir must vent air from the container while the container fills with water to its desired level. For certain applications such as shown in FIG. 2, the reservoir includes an air vent 62 from the interior of the vessel portion 26 to the outlet tube 48. However, for other applications, air may flow out of the container through the outlet tube without the addition of an air vent as discussed below. Whether or not an air vent is required is determined in part by the orientation of the reservoir in its installed position, whether a dip tube is provided on the inlet or the outlet, the position of the outlet aperture and/or the end of the outlet dip tube, and other factors. For example, in the alternative shown in FIG. 2, the reservoir is oriented in an upright position, and a dip tube is provided on the outlet. If no air vent were provided, the reservoir would stop filling at the depth of the end of the dip tube because the air in the container would be captured. However, the reservoir shown in FIG. 2 includes an air vent 62 enabling the reservoir to fill.

Figure 5:
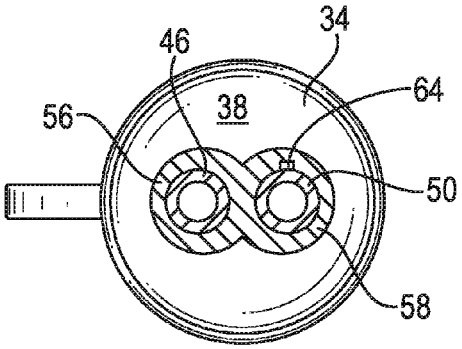
FIG. 5 is a cross-sectional view taken through section 5-5 in FIG. 4.

The air vent 62 shown in FIGS. 2 and 4 includes a groove 64 along an inside surface 66 of the cylindrical outlet flange 58. As shown in FIG. 5, the groove 64 enables air to vent along the side of an upper portion of the dip tube 50. A gap 70 between the dip tube 50 and the outlet tube 48 allows air from the groove 64 to pass between the dip tube and outlet tube and enter the outlet tube 48. A tube stop 72 may be provided in the cylindrical outlet flange 58 to locate the ends of the dip tube 50 and the outlet tube 48 in forming the gap 70.

Figure 6:
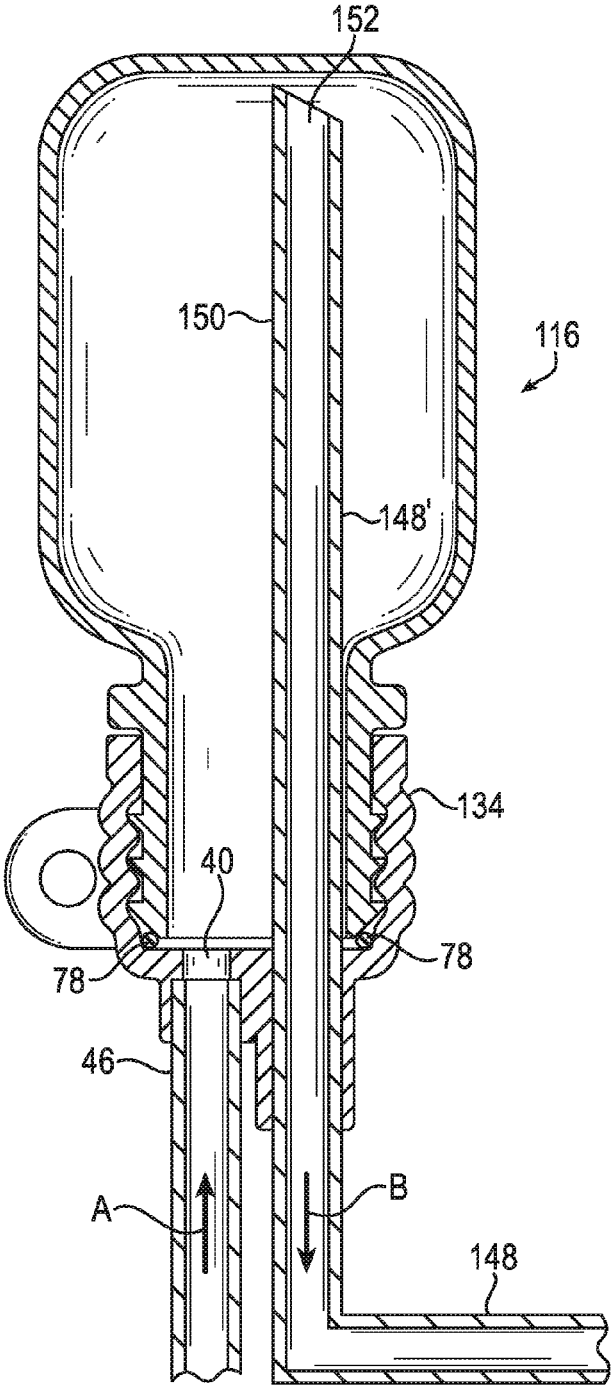
FIG. 6 is a partial cross-sectional view of an alternative reservoir of the present disclosure.

In an alternative reservoir shown in FIG. 6, a reservoir 116 is oriented in a cap-down orientation, having an inlet "A" and an outlet "B." The reservoir 116 includes a cap 134 that has the inlet tube 46, an outlet tube 148, and a dip tube 150 in communication with the outlet tube 148. The open end 152 of the dip tube is higher than the inlet aperture 40, and no additional air vent is needed. Upon filling, air in the container will exit through the open end 152 of the dip tube. In the alternative shown in FIG. 6, the dip tube 150 and the outlet tube 148 may be portions of the same continuous tube 148'. Alternatively, the dip tube 150 and the outlet tube 148 may be separate tubes attached to the cap 134.

In one example, the cap 134 shown in FIG. 6 may be made by overmolding the cap around the tube 148'.

Figure 7:
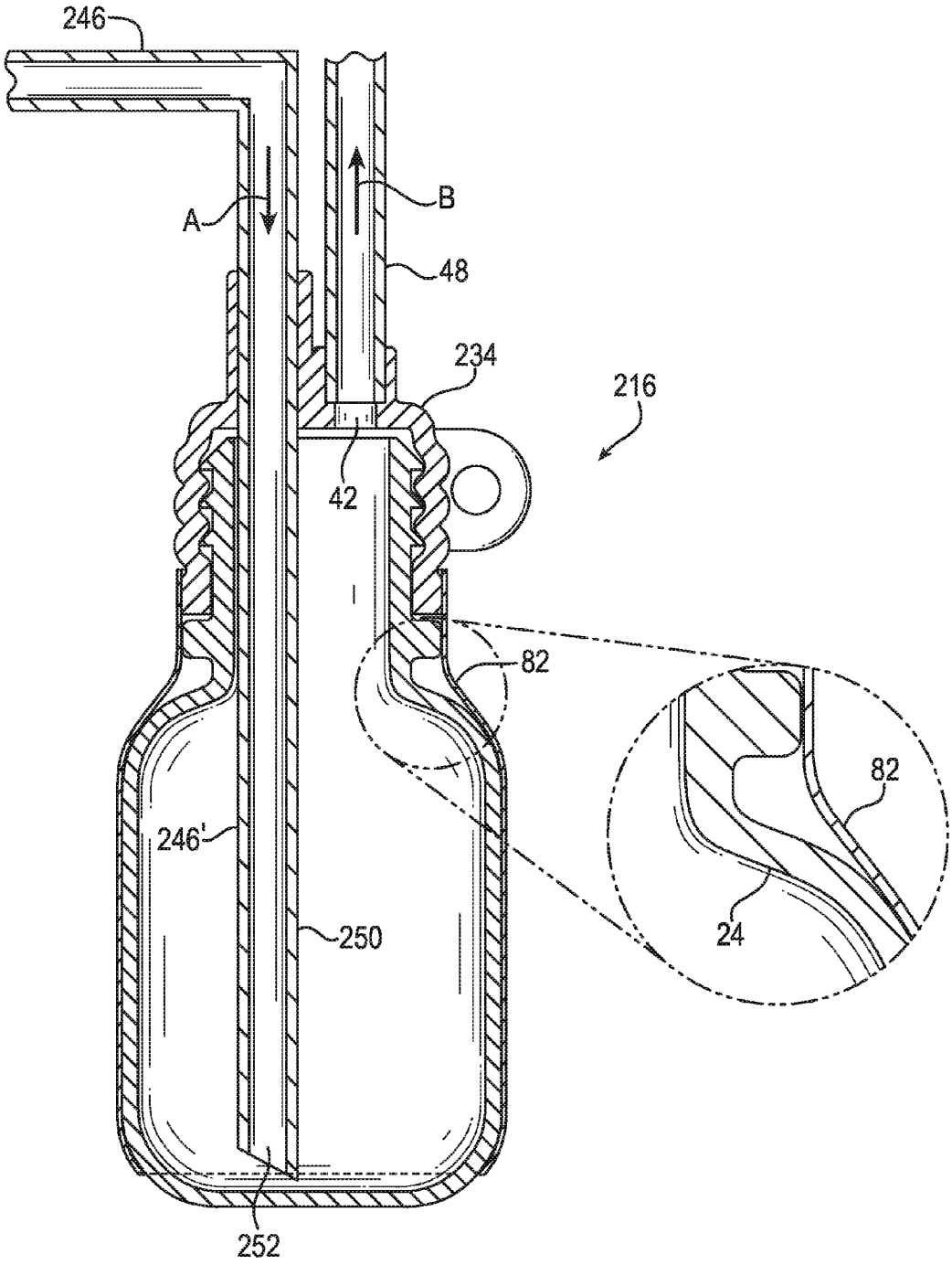
FIG. 7 is a partial cross-sectional view of another alternative reservoir of the present disclosure.

In another alternative reservoir shown in FIG. 7, a reservoir 216 is oriented in an upright orientation, having an inlet "A" and an outlet "B." The reservoir 216 includes a cap 234 that has an inlet tube 246, the outlet tube 48, and a dip tube 250 in communication with the inlet tube 246. The outlet aperture 42 is higher than the open end 252 of the dip tube, and no additional air vent is needed. Upon filling, air in the container will exit through the outlet aperture 42. In the alternative shown in FIG. 7, the dip tube 250 and the inlet tube 246 may be portions of the same continuous tube 246'. Alternatively, the dip tube 250 and the inlet tube 246 may be separate tubes attached to the cap 234.

In one example, the cap 234 shown in FIG. 7 may be made by overmolding the cap around the tube 246'.

Figure 8:
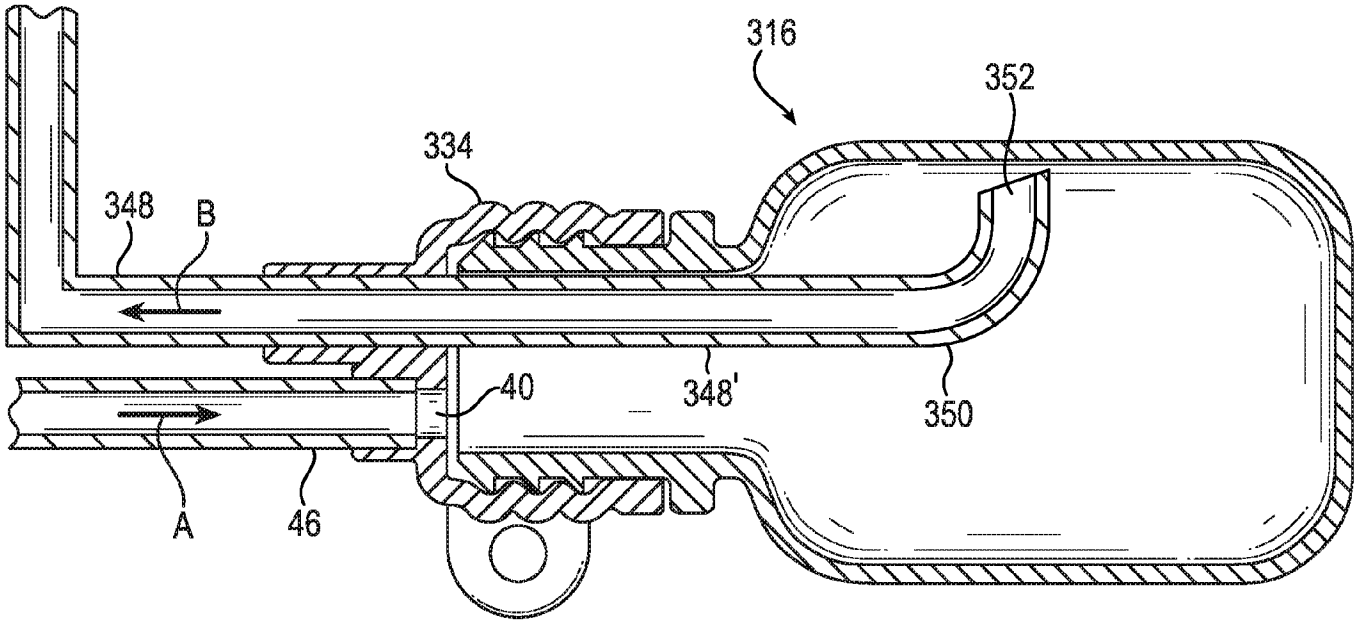
FIG. 8 is a partial cross-sectional view of yet another alternative reservoir of the present disclosure.

In the alternative reservoir shown in FIG. 8, a reservoir 316 is oriented on its side such that the outlet tube is higher than the inlet tube, shown as inlet "A" and an outlet "B." The reservoir 316 includes a cap 334 that has the inlet tube 46, an outlet tube 348, and a dip tube 350 in communication with the outlet tube 348. The open end 352 of the dip tube is higher than the inlet aperture 40, and no additional air vent is needed. Upon filling, air in the container will exit through the open end 352 of the dip tube. In the alternative shown in FIG. 8, the dip tube 350 and the outlet tube 348 may be portions of the same continuous tube 348'. The dip tube 350 may be formed such that the end 352 is positioned in a desired location within the reservoir as shown for example in FIG. 8. Alternatively, the dip tube 350 and the outlet tube 348 may be separate tubes attached to the cap 334.

In one example, the cap 334 shown in FIG. 8 may be made by overmolding the cap around the tube 348'.

Figure 10:
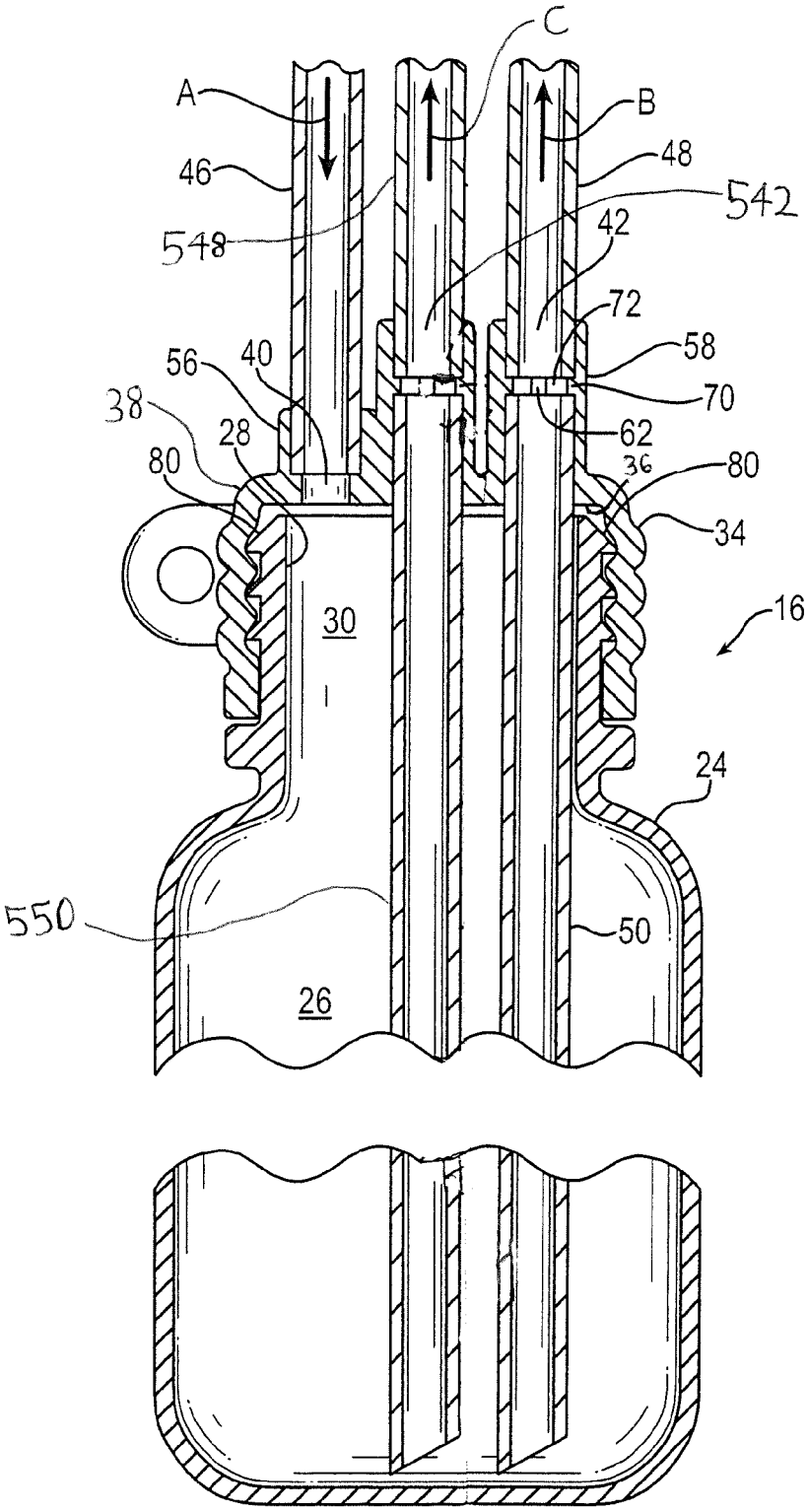
FIG. 10 is a partial cross-sectional view of another alternative reservoir of the present disclosure.

In other alternatives, and as shown in FIG. 10, the cap 34 may include two outlets B and C, by including a second outlet aperture 542 and a second outlet tube 548 in fluid communication with the second outlet aperture 542 extending from the external surface 38. Depending on the bottle orientation as discussed above, a second dip tube 550 may be provided in fluid communication with the second outlet aperture 542 extending from the internal surface 36 into the vessel portion 26 as seen in FIG. 10. Alternatively, and not shown, the cap may include three or more outlets as desired, depending on the desired application. Similarly, the cap may include two or more inlets as desired for the application.

The container may be made of polyethylene terephthalate (PET), polycarbonate, aluminum, stainless steel or other suitable material. The container may be formed from a multilayer material. A barrier film may be provided in at least one layer of the multilayer material, where the barrier layer inhibits passage of one or more from the group consisting of oxygen, carbon dioxide, water vapor, molecules affecting taste, molecules affecting odor.

In certain embodiments, the container 24 is a bottle, such as a bottle formed by injection blow molding. A bottle formed by injection blow molding may be useful in providing a strong material, such as PET, polycarbonate, or the like, at an efficient cost.

In one embodiment of this invention, one or more of the cap, the inlet tube, and the outlet tube are made from high density polyethylene that is crosslinked (PEX), and thus are made from a different material that the container or bottle. The inlet tube and the outlet tube may be flexible or comprise flexible tubing. PEX contains crosslinked bonds in the polymer structure changing the thermoplastic into a thermoset. Crosslinking may be accomplished during or after the molding of the part. The required degree of crosslinking for crosslinking polyethylene tubing, according to ASTM Standard F 876-93, is between 65-89%. There are three classifications of PEX, referred to as PEX-A, PEX-B, and PEX-C. PEX-A is made by the peroxide (Engel) method. In the PEX-A method, peroxide blended with the polymer performs crosslinking above the crystal melting temperature. The polymer is typically kept at high temperature and pressure for long periods of time during the extrusion process. PEX-B is formed by the silane method, also referred to as the "moisture cure" method. In the PEX-B method, silane blended with the polymer induces crosslinking during molding and during secondary post-extrusion processes, producing crosslinks between a crosslinking agent. The process is accelerated with heat and moisture. The crosslinked bonds are typically formed through silanol condensation between two grafted vinyltrimethoxysilane units. PEX-C is produced by application of an electron beam using high energy electrons to split the carbon-hydrogen bonds and facilitate crosslinking.

Crosslinking imparts shape memory properties to polymers. Shape memory materials have the ability to return from a deformed state (e.g. temporary shape) to their original crosslinked shape (e.g. permanent shape), typically induced by an external stimulus or trigger, such as a temperature change. Alternatively or in addition to temperature, shape memory effects can be triggered by an electric field, magnetic field, light, or a change in pH, or even the passage of time. Shape memory polymers include thermoplastic and thermoset (covalently crosslinked) polymeric materials.

Shape memory materials are stimuli-responsive materials. They have the capability of changing their shape upon application of an external stimulus. A change in shape caused by a change in temperature is typically called a thermally induced shape memory effect. The procedure for using shape memory typically involves conventionally processing a polymer to receive its permanent shape, such as by molding the polymer in a desired shape and crosslinking the polymer defining its permanent crosslinked shape. Afterward, the polymer is deformed and the intended temporary shape is fixed. This process is often called programming. The programming process may consist of heating the sample, deforming, and cooling the sample, or drawing the sample at a low temperature. The permanent crosslinked shape is now stored while the sample shows the temporary shape. Heating the shape memory polymer above a transition temperature Ttrans induces the shape memory effect providing internal forces urging the crosslinked polymer toward its permanent or crosslinked shape. Alternatively or in addition to the application of an external stimulus, it is possible to apply an internal stimulus (e.g., the passage of time) to achieve a similar, if not identical result.

A crosslinked polymer network may be formed by low doses of irradiation. Polyethylene chains are oriented upon the application of mechanical stress above the melting temperature of polyethylene crystallites, which can be in the range between 60° C. and 134° C. Materials that are most often used for the production of shape memory linear polymers by ionizing radiation include high density polyethylene, low density polyethylene and copolymers of polyethylene and poly(vinyl acetate). After shaping, for example, by extrusion or compression molding, the polymer is covalently crosslinked by means of ionizing radiation, for example, by highly accelerated electrons. The energy and dose of the radiation are adjusted to the geometry of the sample to reach a sufficiently high degree of crosslinking, and hence sufficient fixation of the permanent shape.

Another example of chemical crosslinking includes heating poly(vinyl chloride) under a vacuum resulting in the elimination of hydrogen chloride in a thermal dehydrochlorination reaction. The material can be subsequently crosslinked in an HCl atmosphere. The polymer network obtained shows a shape memory effect. Yet another example is crosslinked poly[ethylene-co-(vinyl acetate)] produced by treating the radical initiator dicumyl peroxide with linear poly[ethylene-co-(vinyl acetate)] in a thermally induced crosslinking process. Materials with different degrees of crosslinking are obtained depending on the initiator concentration, the crosslinking temperature and the curing time. Covalently crosslinked copolymers made from stearyl acrylate, methacrylate, and N,N'-methylenebisacrylamide as a crosslinker.

Additionally shape memory polymers include polyurethanes, polyurethanes with ionic or mesogenic components, block copolymers consisting of polyethyleneterephthalate and polyethyleneoxide, block copolymers containing polystyrene and poly(1,4-butadiene), and an ABA triblock copolymer made from poly(2-methyl-2-oxazoline) and poly (tetrahydrofuran). Further examples include block copolymers made of polyethylene terephthalate and polyethylene oxide, block copolymers made of polystyrene and poly(1,4-butadiene) as well as ABA triblock copolymers made from poly(tetrahydrofuran) and poly(2-methyl-2-oxazoline). Other thermoplastic polymers which exhibit shape memory characteristics include polynorbornene, and polyethylene grated with nylon-6 that has been produced for example, in a reactive blending process of polyethylene with nylon-6 by adding maleic anhydride and dicumyl peroxide.

The cap 34 may be sealed to the container 24 in a fluid-tight or leak-free seal using shape memory properties of a selected polymer as discussed above. As shown in FIG. 4, the cap may be formed to a desired size, having an inside dimension 74 smaller than a corresponding outside dimension of the container neck 28, and then crosslinked. Crosslinking of the cap sets a permanent cap size smaller than the desired outside dimension of the container neck. Then, installing the cap onto the container requires expanding the dimension of the cap to fit onto the neck, installing the cap onto the neck, and then applying an external stimulus, such as temperature, or an internal stimulus, such as by the passage of time, for the shape memory of the polymer to tend toward its permanent shape. The contraction of the cap around the container may be used to form a fluid-tight or leak-free seal. In another alternative, the cap and container are cooperatively threaded, and the cap screws onto the container.

For certain applications, an o-ring 78 or gasket seal may be provided between the cap and the container, such as an o-ring 78 shown in FIG. 6 between the cap inside surface and the container neck. In certain embodiments, the cap may sealingly engage the container by only one seal, whether by one o-ring 78 (as shown in FIG. 6), one gasket (not shown), or one cap-to-container contact surface 80 (as shown in FIG. 2) around the opening 30.

The opening 30 is circular for typical applications, however, it is contemplated that the opening and neck around the opening may be any shape as desired. The neck and opening may have a diameter or dimension smaller than the corresponding dimension across the vessel portion of the container. Alternatively, the neck and opening may have a diameter or dimension about the same as the corresponding dimension across the vessel portion of the container.

Figure 9:
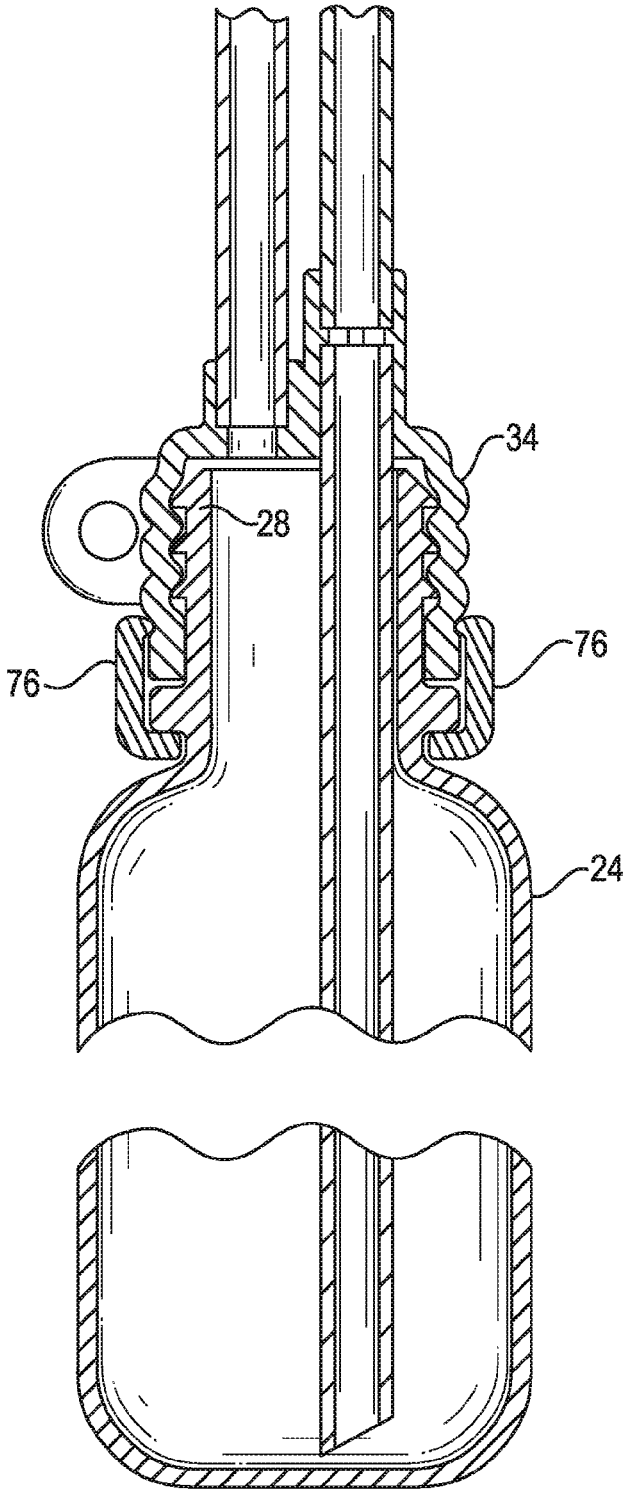
FIG. 9 is a partial cross-sectional view of the reservoir of FIG. 2 with a ring around the cap and container neck.

As shown in FIG. 9, the reservoir may include a ring 76 cooperatively engaging the cap 34 and the container 24, such as engaging the cap 34 and neck 28. The cap and/or the container may include structure such as ribs, protrusions, texture, or other features for engaging the ring. The ring 76 may be overmolded around the cap and container. Alternatively, the ring may be a clamp around the cap and container. In yet another alternative, the ring is made of crosslinked polyethylene, affixed to the cap and container by shape memory as discussed above. A ring may be useful in strengthening the connection between the cap and container such that the reservoir may withstand increased internal pressure without the cap separating from the container.

The reservoir may include a sleeve or similar housing around at least a portion of the reservoir. As shown in FIG. 7, the sleeve may be a shrink-wrap film 82. Alternatively, the sleeve may be a braided material. A sleeve may be useful in strengthening the reservoir such that the reservoir may withstand increased internal pressure before failure. In one alternative, the sleeve may be provided in conjunction with the container having a thinner wall thickness sized to withstand with the sleeve the same internal pressure as a thicker container without the sleeve.

Certain embodiments of the presently disclosed reservoir may be produced by a method including steps of:

providing a container having a vessel portion terminating at a neck around an opening;

selecting a polymeric inlet tube having a pair of opposed inlet tube ends and a polymeric outlet tube having a pair of opposed outlet tube ends, inserting at least an end portion of one of the pair of opposed inlet tube ends into a mold cavity;

inserting at least an end portion of one of the pair of opposed outlet tube ends into the mold cavity;

injection overmolding a cap over at least a portion of the inserted inlet and outlet tube ends, the cap having an inside dimension smaller than a corresponding outside dimension of the container neck, the step of injection overmolding forming a material-to-material bond by melt fusion in an interfacial region between at least a portion of an exterior surface of the inserted inlet and outlet tube ends and corresponding interior surfaces of the overmolded cap;

crosslinking the overmolded cap, the inlet tube, and the outlet tube;

expanding the cap inside dimension to fit onto the neck and installing the cap onto the neck, the inlet tube and the outlet tube in fluid communication with the vessel portion; and applying an external or internal stimulus to the cap to contract the cap about the neck forming a fluid-tight seal.

Alternatively, a process for making a reservoir may include steps of:

providing a container having a vessel portion terminating at a neck around an opening;

selecting a polymeric inlet tube having a pair of opposed inlet tube ends and a polymeric outlet tube having a pair of opposed outlet tube ends, inserting at least an end portion of one of the pair of opposed inlet tube ends into a mold cavity;

inserting at least an end portion of one of the pair of opposed outlet tube ends into the mold cavity;

injection overmolding a cap over at least a portion of the inserted inlet and outlet tube ends, the step of injection overmolding forming a material-to-material bond by melt fusion in an interfacial region between at least a portion of an exterior surface of the inserted inlet and outlet tube ends and corresponding interior surfaces of the overmolded cap, where the cap and container neck are cooperatively threaded; and installing the threaded cap onto the cooperatively threaded neck forming a fluid-tight seal, the inlet tube and the outlet tube in fluid communication with the container vessel portion.

While the invention has been illustrated and described in detail in the drawings and foregoing description, the same is to be considered as illustrative and not restrictive in character, it being understood that only preferred embodiments have been shown and described and that all changes and modifications that come within the spirit of the invention are desired to be protected by the appended claims and the equivalents thereof.

What is claimed is:

1. A reservoir for use in a water distribution system within a refrigeration device comprising:

a container having a vessel portion terminating at a neck around an opening, a cap sealingly engaging the container, the cap comprising:

an internal surface in communication with an interior of the vessel portion, an external surface opposite the internal surface, an inlet aperture and an outlet aperture through the cap in fluid communication with the container opening, an inlet tube in fluid communication with the inlet aperture extending from the external surface, an outlet tube in fluid communication with the outlet aperture extending from the external surface, the reservoir being oriented in the upright position such that the cap is located above the vessel portion when the reservoir is installed in the refrigeration device, a dip tube in fluid communication with the outlet aperture extending from the internal surface into and near the bottom of the vessel, the cap further comprising a cylindrical outlet flange connecting the outlet tube and the dip tube, the outlet tube and the dip tube positioned within the cylindrical outlet flange, and an air vent from the interior of the vessel portion to the outlet tube, where the air vent comprises a groove in an inside surface of the cylindrical outlet flange in communication with the interior of the vessel portion extending along an outside surface of the dip tube adjacent to the outlet tube, and an opening in the outlet tube in communication with the groove, where a gap between the dip tube and the outlet tube allows air from the groove to pass between the dip tube and the outlet tube and enter the outlet tube.

2. The reservoir as claimed in claim 1, where the dip tube and the outlet tube are a single tube.

3. The reservoir as claimed in claim 1, the cap further comprising a cylindrical inlet flange sealingly engaging an end of the inlet tube forming the inlet aperture and the cylindrical outlet flange sealingly engaging an end of the outlet tube forming the outlet aperture.

4. The reservoir as claimed in claim 3 with at least one selected from the group consisting of the inlet tube frictionally engaging the cylindrical inlet flange and the outlet tube frictionally engaging the cylindrical outlet flange.

5. The reservoir as claimed in claim 3 with at least one selected from the group consisting of the cylindrical inlet flange overmolded around the inlet tube end and the cylindrical outlet flange overmolded around the outlet tube end.

6. The reservoir as claimed in claim 3, the cylindrical outlet flange connecting the outlet tube and the dip tube, the dip tube frictionally engaging the cylindrical outlet flange.

7. The reservoir as claimed in claim 1, the cap comprising a cylindrical inlet flange sealingly engaging an end of the inlet tube forming the inlet aperture.

8. The reservoir as claimed in claim 7 with the inlet tube frictionally engaging the cylindrical inlet flange.

9. The reservoir as claimed in claim 7 with the cylindrical inlet flange overmolded around the inlet tube end.

10. The reservoir as claimed in claim 7, further comprising a dip tube in fluid communication with the inlet aperture extending from the internal surface into the vessel portion, the cylindrical inlet flange connecting the inlet tube and the dip tube, the dip tube frictionally engaging the cylindrical inlet flange.

11. The reservoir as claimed in claim 1, where the cap frictionally engages the container.

12. The reservoir as claimed in claim 1, where the cap and container are cooperatively threaded, and the cap screws onto the container.

13. The reservoir as claimed in claim 1, further comprising an o-ring or gasket seal between the cap and the container.

14. The reservoir as claimed in claim 1, further comprising a second outlet aperture, and a second outlet tube in fluid communication with the second outlet aperture extending from the external surface.

15. The reservoir as claimed in claim 14, further comprising a second dip tube in fluid communication with the second outlet aperture extending from the internal surface into the vessel portion.

16. The reservoir as claimed in claim 1, where the cap is made of crosslinked polyethylene.

17. The reservoir as claimed in claim 1, further comprising a ring cooperatively engaging the cap and the container.

18. The reservoir as claimed in claim 17, where the ring is overmolded around the cap and container.

19. The reservoir as claimed in claim 17, where the ring is made of crosslinked polyethylene.

20. The reservoir as claimed in claim 1, where container is formed from a multilayer material.

21. The reservoir as claimed in claim 10, where at least one layer of the multilayer material is a barrier layer inhibiting passage of one or more from the group consisting of oxygen, carbon dioxide, water vapor, molecules affecting taste and molecules affecting odor.

22. The reservoir as claimed in claim 1, further comprising a sleeve around at least a portion of the container.

23. The reservoir as claimed in claim 1, further comprising a tube stop in the cylindrical outlet flange for locating the ends of the dip tube and the outlet tube in forming the gap.

* * * * *